United States Patent [19]

Goralnik

[11] 4,234,916

[45] Nov. 18, 1980

[54] LIGHTING FIXTURE

[76] Inventor: Charles D. Goralnik, 200 Brynwych Pl., St. Louis County, Mo. 63141

[21] Appl. No.: 934,461

[22] Filed: Aug. 17, 1978

[51] Int. Cl.[3] ..... F21S 1/02; F21V 15/00; F21V 21/02; F21V 29/00

[52] U.S. Cl. ..... 362/294; 362/285; 362/368; 362/373; 362/374; 362/375; 362/382; 362/404; 362/408; 362/418; 362/430; 362/433; 362/457; 248/343

[58] Field of Search ..... 362/154, 374, 375, 430, 362/365, 439, 404, 408, 418, 436, 437, 449, 285, 319, 382, 396, 457, 368, 373, 433, 294; 248/343

[56] References Cited

U.S. PATENT DOCUMENTS

| | | | |
|---|---|---|---|
| 1,462,132 | 7/1923 | Cordingly | 362/439 |
| 1,507,758 | 9/1924 | Scott | 362/404 |
| 1,529,823 | 3/1925 | Adam | 248/343 |
| 1,535,696 | 4/1925 | Sprecher | 248/343 |
| 1,564,609 | 12/1925 | Morgenstern | 248/343 |
| 1,617,184 | 2/1927 | Spott | 248/343 |
| 1,618,610 | 2/1927 | Tierney | 248/343 |
| 1,693,396 | 11/1928 | Littleton | 362/430 |
| 1,703,649 | 2/1929 | Weinstein | 248/343 |
| 1,782,791 | 11/1930 | Nielsen | 248/343 |
| 1,844,639 | 2/1932 | Crumpton | 362/365 |
| 1,878,084 | 9/1932 | Winkler | 248/343 |
| 1,885,514 | 11/1932 | Deubler | 248/343 |
| 2,638,531 | 5/1953 | Levy | 362/373 |
| 2,907,545 | 10/1959 | Beck et al. | 248/343 |
| 2,918,569 | 12/1959 | McCormack | 362/294 |
| 3,461,283 | 8/1969 | Hahn | 362/374 |
| 3,836,766 | 9/1974 | Auerbach | 362/374 |
| 4,044,246 | 8/1977 | Docimo et al. | 362/294 |
| 4,104,713 | 8/1978 | Chan et al. | 362/294 |

*Primary Examiner*—Teddy S. Gron

*Attorney, Agent, or Firm*—Senniger, Powers, Leavitt and Roedel

[57] ABSTRACT

A lighting fixture adapted to be mounted on a ceiling by attachment to an outlet box in the ceiling. The fixture comprises a pan having an upwardly extending rim and a crossbar attached to the bottom of the outlet box in a position extending horizontally across the bottom of the box. The rim of the pan is adapted to be attached to at least one end of the crossbar for mounting the pan adjacent the ceiling.

14 Claims, 8 Drawing Figures

LIGHTING FIXTURE

BACKGROUND OF THE INVENTION

This invention relates to lighting fixtures of the type adapted to be mounted on a ceiling by attachment to an outlet box in the ceiling. This type of fixture is sometimes referred to in the trade as a flush-mounted ceiling fixture.

Prior art lighting fixtures of this type generally comprise a fixture pan having a light socket secured to the bottom thereof, and a crossbar attached, as by screws, horizontally across the bottom of the outlet box. The pan is fastened to the crossbar by a screw (or screws) extending up through the pan and threaded through the bar, with the upper end of the screw projecting up into the outlet box. This arrangement has presented certain problems, however, inasmuch as the screw conducts heat generated by the light source up into the outlet box, resulting in unacceptably high temperatures in the outlet box, and presenting a fire hazard. The ceiling may also become overheated.

SUMMARY OF THE INVENTION

Among the several objects of this invention may be noted the provision of a lighting fixture of the aforementioned type which effectively reduces the amount of heat transferred from a light source within the fixture to the ceiling and outlet box; the provision of such a fixture which is pleasing in appearance; the provision of such a fixture which is easy to attach to an outlet box; and the provision of such a fixture which is economical to manufacture.

Generally, a lighting fixture of this invention is of the aforementioned type and comprises a pan having an upwardly extending rim and a crossbar adapted to be attached to the bottom of the outlet box in position extending horizontally across the bottom of the box. The rim of the pan is adapted to be attached, via attaching means, to at least one end of the crossbar for mounting the pan adjacent the ceiling.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
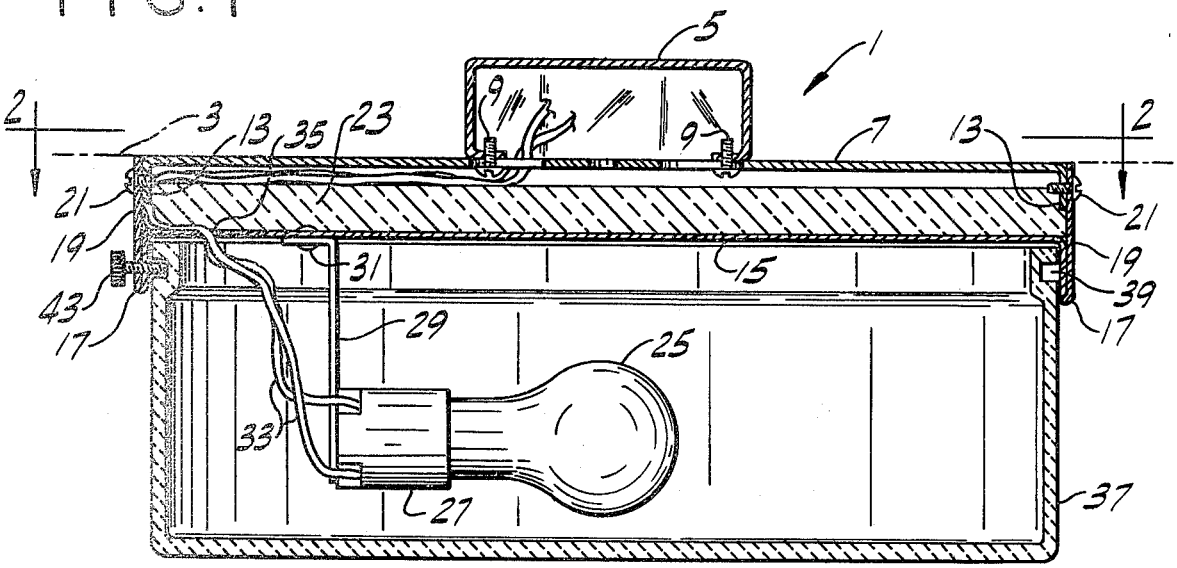
FIG. 1 is a vertical section of a lighting fixture of this invention shown mounted on a ceiling by attachment to an outlet box in the ceiling.
Figure 2:
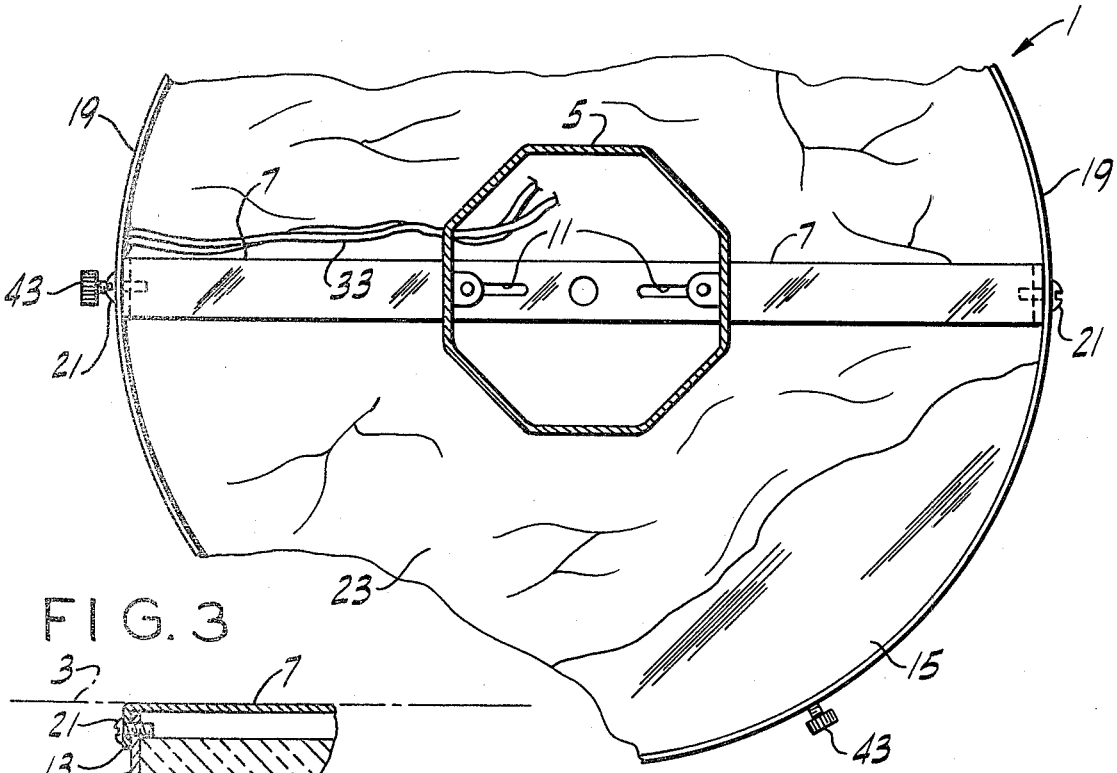
FIG. 2 is a horizontal section taken on line 2—2 of FIG. 1.

Referring now to the drawings, particularly to FIGS. 1 and 2, a lighting fixture of this invention is designated generally by the reference numeral 1 and is shown mounted on a ceiling 3 by attachment to a standard junction or outlet box 5 recessed in the ceiling. This fixture comprises a flat, relatively narrow crossbar 7 extending horizontally across the bottom of the outlet box 5 and laterally outward from the box beyond opposite sides of the box generally flush with the ceiling 3. Screws 9 extending up through a pair of elongate slots 11 in the crossbar 7 and threaded into the outlet box secure the crossbar to the box. The crossbar 7 has downwardly extending flanges, each indicated at 13, at its ends.

Disposed below the the crossbar and indicated at 15 is a generally circular base or pan, the outer margins of which are bent down to form an annular lip 17 on the underside of the pan and then back up, forming a rim 19 which extends up above the pan at the periphery thereof. As shown, the length of crossbar 7 generally corresponds to the distance between opposite sides of the rim, and the flanges 13 at the ends of the crossbar extend down on the inside of rim 19 to interfit in face-to-face relation with the latter at opposite sides thereof. The fact that the flanges are on the inside of the rim is advantageous inasmuch as they are concealed from view by the rim for enhancing the attractiveness of the lighting fixture. It will be understood, however, that the flanges 13 could also extend on the outside of rim 19 (see FIG. 3) without departing from the scope of this invention. The rim is attached to the flanges by any suitable means, such as screws 21. A layer of suitable insulation 23 (fiberglass insulation, for example) covers the entire upper surface of the pan 15.

A conventional incandescent light bulb and socket, indicated at 25 and 27, respectively, are mounted below the pan by means of a bracket 29 riveted at 31 to the underside of the pan. As illustrated in FIG. 1, the bulb is spaced away from the bottom of the pan, which is substantially continuous and free of any relatively large openings therein, to reduce heat build-up in the pan. The socket 27 is connected to a suitable electrical source (not shown) via wires 33 which extend down from the outlet box around the edge of the insulation 23 adjacent the rim 19 of the pan and thence down through a relatively small hole 35 in the pan to socket 27. Hole 35 is preferably in the peripheral portion of the pan to reduce the amount of heat transferred from the light source to the space above the pan. Of course, fiberglass insulation 23 also helps to minimize the amount of heat transferred to the ceiling 3 and outlet box 5.

Indicated at 37 immediately below pan 15 and enclosing light bulb 25 is a generally round, light-diffusing cover or diffuser which may be of glass or other suitable material. This cover 37 has a peripheral groove 39 therein toward its upper edge for receiving a plurality (e.g., three) of thumbscrews, each designated 43, threaded through the downwardly extending lip 17 of pan 15 at equal intervals (e.g., 120°) around the lip.

It will be observed from the foregoing that the above-described lighting fixture 1 is effective to reduce the transfer of heat from the light source (light bulb 25)

upwardly to the ceiling 3 and outlet box 5. Thus, it should be noted that screws 21 fastening the rim 19 of pan 15 to the flanges 13 at the ends of the crossbar 7 are exposed to the cooler air outside the lighting fixture, and that the fasteners 9 securing the crossbar to the outlet box 5 are entirely insulated from heat build-up in the cover 37 and pan 15 by the layer of insulation 23 above the pan.

Figure 3:
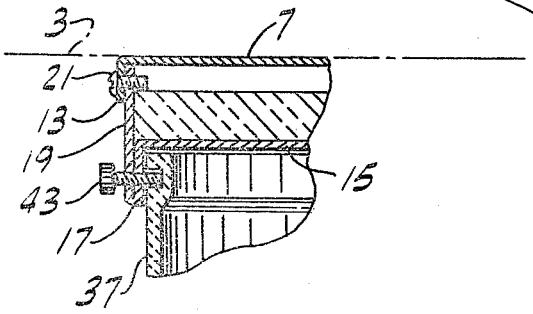
FIG. 3 is a fragmentary detail, illustrating a different arrangement between the component parts of the lighting fixture.
Figure 4:
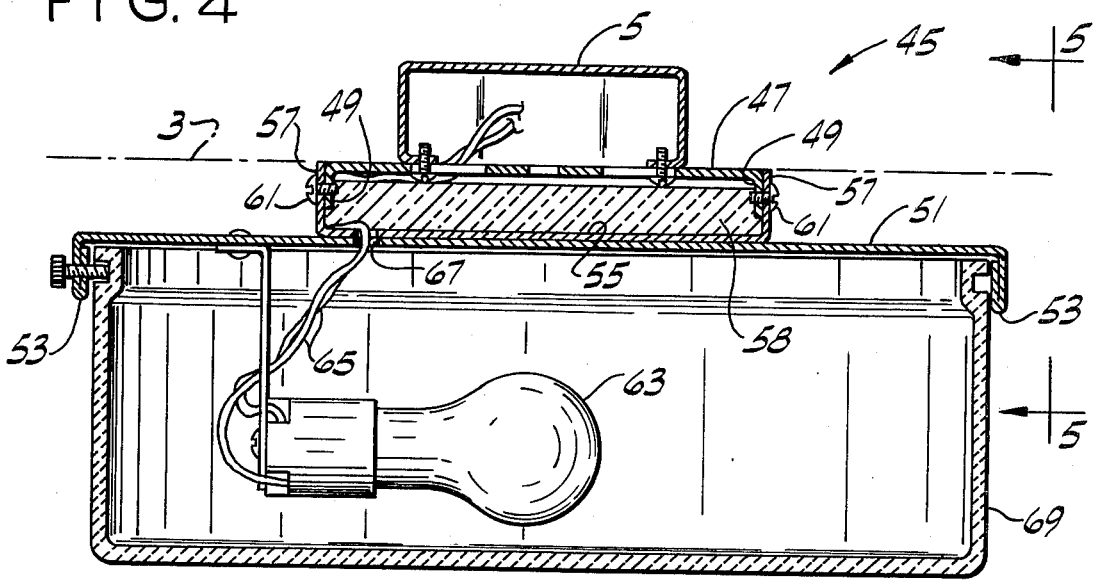
FIG. 4 is a view similar to FIG. 1, illustrating an alternative lighting fixture of this invention.
Figure 5:
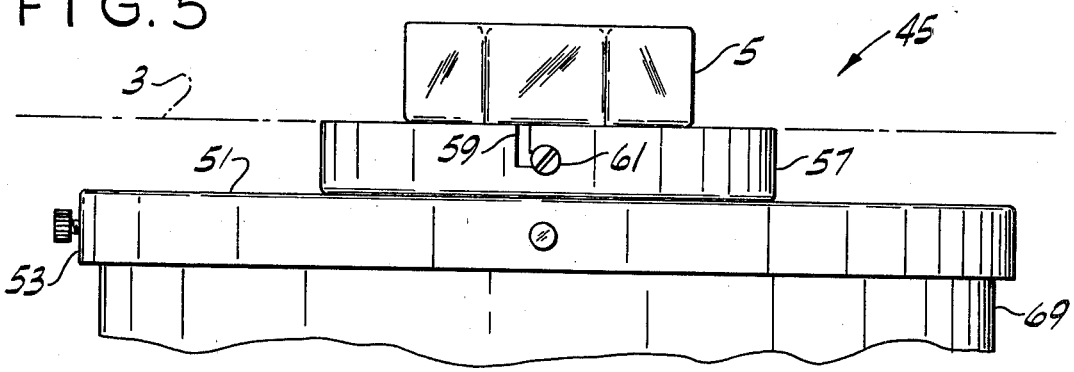
FIG. 5 is a left-side elevation of the lighting fixture shown in FIG. 4.
Figure 6:
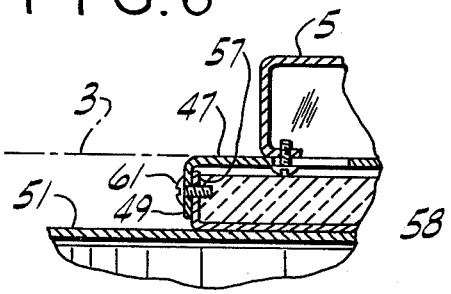
FIG. 6 is a fragmentary detail showing the component parts of a fixture arranged somewhat differently than in FIG. 4.

Referring now to FIGS. 4–6, an alternative lighting fixture of this invention, indicated generally at 45, is shown to comprise a crossbar 47 similar to but shorter than the crossbar 7 shown in FIGS. 1–3. Crossbar 47 is secured to the bottom of outlet box 5 and has downwardly turned ends forming flanges 49. This fixture also includes a relatively large circular pan 51 having a lip 53 extending downwardly at its periphery. Rigidly secured, as by welding, to the top of this pan 51, is a smaller pan-shaped spacer 55 having an upwardly extending circular rim 57. As shown, this rim is dimensioned for interfitting in face-to-face relation with the flanges 49 of the crossbar, the flanges extending down on the inside of the rim at opposite sides thereof. As stated above with regard to fixture 1, however, the flanges 49 may extend down on the outside of the rim 57 (see FIG. 6) without departing from the scope of this invention. Insulation of a suitable type (fiberglass, for example) covers the bottom of the spacer 55 and is indicated by reference numeral 58.

For fastening the rim 57 of the spacer 55 to the flanges 49 at the ends of the crossbar 47, L-shaped bayonet slots, each designated 59 (FIG. 5), extend down from the upper edge of the rim on opposite sides thereof for receiving screws 61 threaded out from the flanges. By raising the pan-and-spacer assembly upwardly to insert the screws 61 in the vertical portions of these bayonet slots 59 and then twisting the assembly in one direction (to the left as viewed in FIg. 5) relative to the crossbar 47, so as to position screws 61 in the horizontal portions of the bayonet slots, the assembly may be quickly and easily locked to the crossbar. Removal of the pan-and-spacer assembly from the crossbar is readily accomplished simply by twisting the assembly in the opposite direction and pulling it down away from the ceiling. Of course, it will be understood that the rim 57 of spacer 55 may be fastened to the crossbar 47 in other fashions.

A light source 63 is mounted below the pan 51 in a manner identical to that described in regard to fixture 1, and is electrically connected to a power source (not shown) by wires 65 extending down from the outlet box 5 through a hole or wireway 67 in the spacer 55 and pan 51. A cover for the light source is indicated at 69 and is supported beneath the pan 51, also in a manner identical to that described with respect to fixture 1.

The construction of this alternative fixture 45 affords an important advantage in that the crossbar 47 and outlet box 5 are totally isolated, via the rim 57 of spacer 55, from the portions of the fixture (i.e., the pan 51 and cover 69) that become hot when the light source is on, thus reducing the amount of heat transferred to the crossbar and outlet box. The insulation 58 within the spacer also reduces the heat transferred to the outlet box. And since the pan 51 is spaced from the ceiling by the spacer 55, overheating of the ceiling is also prevented. Moreover, a spacer of a single size may be used with different sized pans 51, thus saving in production costs.

Figure 7:
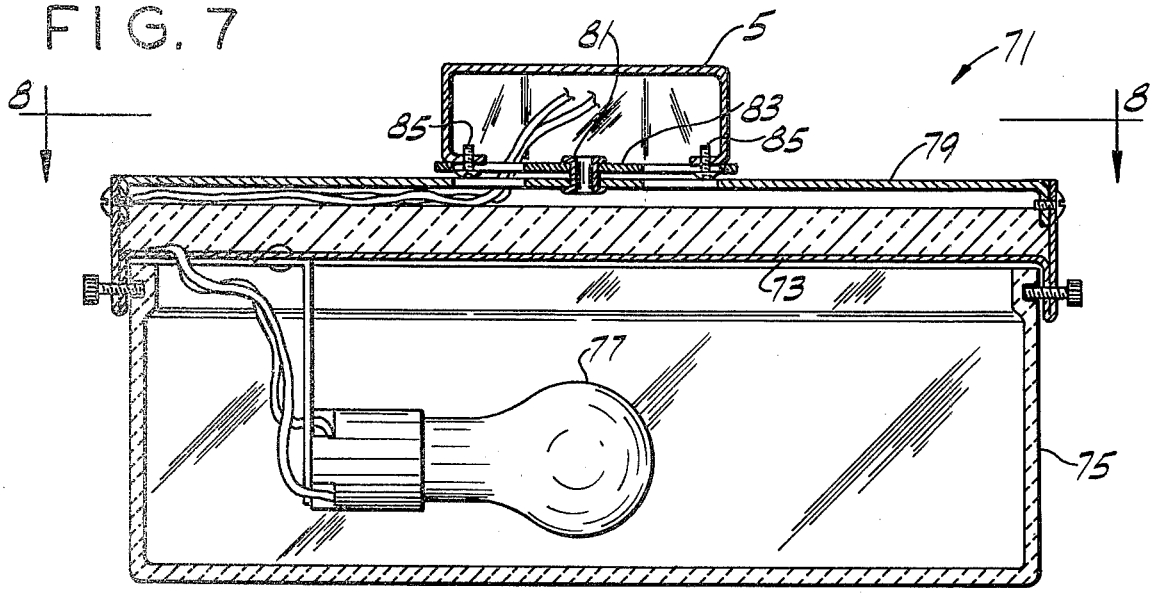
FIG. 7 is a view similar to FIG. 4, illustrating still another alternative lighting fixture adapted to swivel on the outlet box in the ceiling.
Figure 8:
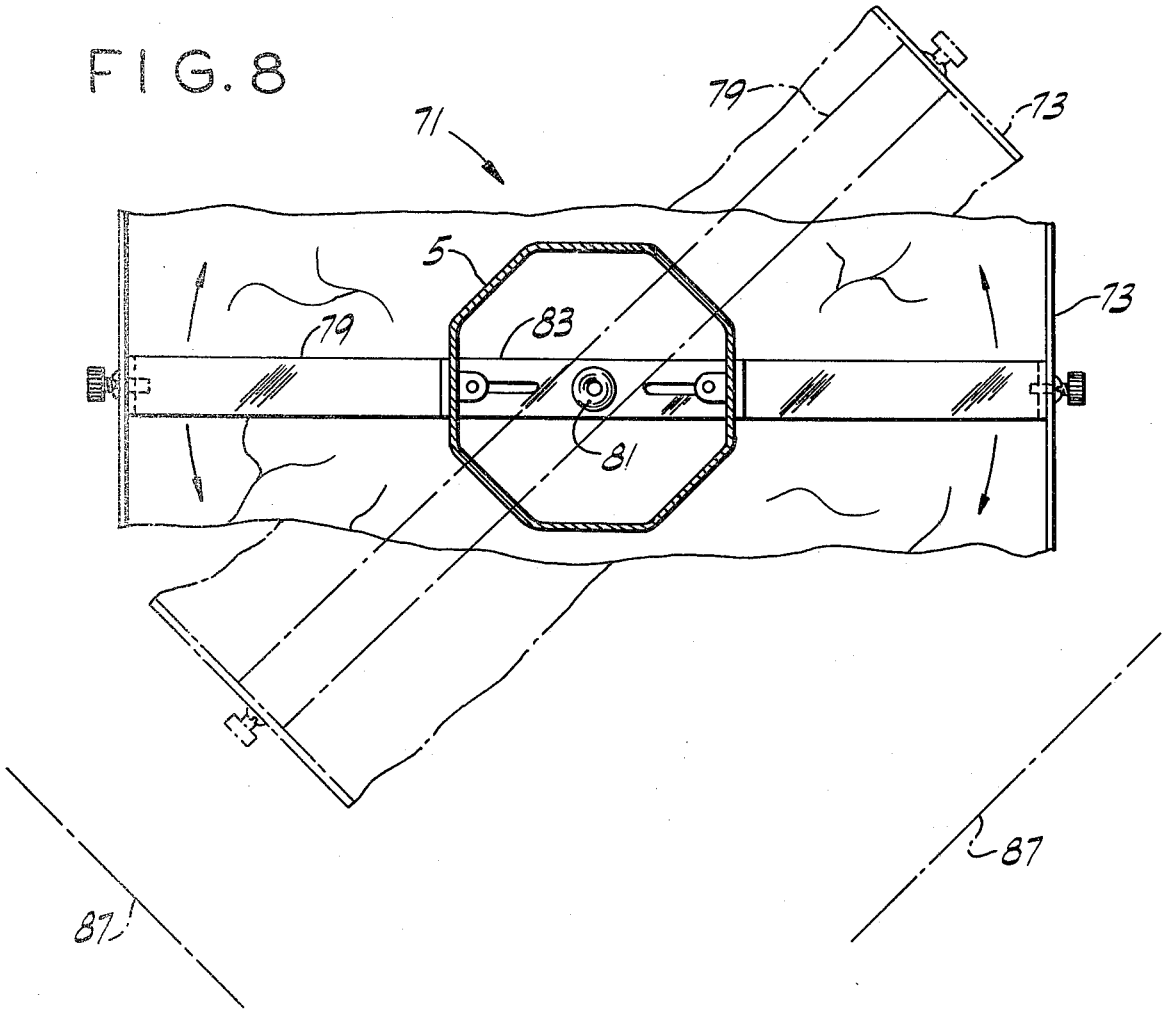
FIG. 8 is a horizontal section taken on line 8—8 of FIG. 7, illustrating the fixture swiveling relative to the outlet box.

FIGS. 7 and 8 illustrate a light fixture 71 identical to that shown in FIGS. 1–3 except that the pan 73, rather than being circular, is rectangular in shape, as is the cover 75 for the light source 77. And instead of being secured directly to the outlet box 5, the crossbar 79 is pivotally connected, as by a rivet 81, to a mounting bar 83 rigidly secured across the bottom of the outlet box via screws 85. Thus, the fixture 71 can be swiveled relative to the outlet box about a generally vertical axis. This is advantageous inasmuch as the sides of the pan 73 and cover 75 can readily be aligned with the walls 87 of a room, if so desired.

Although the lighting fixtures 1, 45 and 71 are shown in the drawings as mounted on a ceiling, it will be understood that they can also suitably be mounted on a wall or other structure.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A lighting fixture adapted to be mounted on a ceiling by attachment to an outlet box in the ceiling, comprising:

a crossbar adapted to be attached to the bottom of the outlet box in position extending horizontally across the bottom of the box, a pan having a relatively thin flat bottom adapted to extend generally horizontally below the crossbar and spaced therefrom, a rim extending upwardly from the bottom of the pan, means for attaching the rim to the crossbar, a lip extending downwardly from the bottom of the pan generally at the periphery thereof, means secured to the bottom of the pan for mounting a light source on the underside of the pan, a diffuser for surrounding said light source, means for fastening the diffuser on the underside of the pan adjacent said lip, the bottom of the pan being substantially continuous and free of any relatively large openings therein, and insulation in the pan above the bottom of the pan and said mounting means for thermally insulating the light source, said mounting means and the pan from the outlet box thereby to reduce the transfer of heat generated by the light source to the outlet box.

2. A lighting fixture as set forth in claim 1 wherein said rim is at the periphery of the pan.

3. A lighting fixture as set forth in claim 2 wherein said rim and said lip are integrally formed, the lower margins of said lip being bent upwardly on the outside of the lip to form said rim.

4. A lighting fixture as set forth in claim 1 wherein said diffuser is adapted for attachment to said lip via said fastening means.

5. A lighting fixture as set forth in claim 1 wherein the crossbar is of such length as to extend laterally outwardly from the box beyond opposite sides of the box and has a downwardly extending flange at each of its ends, the rim being dimensioned in accordance with the length of the crossbar for interfitting in face-to-face relation with the flanges at the ends of the bar.

6. A lighting fixture as set forth in claim 5 wherein the flanges extend down on the inside of the rim.

7. A lighting fixture as set forth in claim 5 wherein the flanges extend down on the outside of the rim.

8. A lighting fixture as set forth in claim 5 wherein the rim is at the periphery of the pan, and the length of the crossbar generally corresponds to the distance between opposite sides of the rim where the flanges interfit with the rim.

9. A lighting fixture as set forth in claim 8 wherein the flanges extend down on the inside of the rim.

10. A lighting fixture as set forth in claim 8 wherein the flanges extend down on the outside of the rim.

11. A lighting fixture as set forth in claim 5 wherein the rim has bayonet slots extending down from its upper edge for receiving said fastening means, the latter extending from the flanges into the slots.

12. A lighting fixture as set forth in claim 11 wherein the rim is of smaller dimension than the pan.

13. A lighting fixture as set forth in claim 12 wherein the rim and pan are circular and the rim is of smaller diameter than the pan.

14. A lighting fixture as set forth in claim 1 wherein said lip extends down on the outside of the diffuser.

* * * * *